US007070489B2

(12) United States Patent
Rogmark

(10) Patent No.: US 7,070,489 B2
(45) Date of Patent: Jul. 4, 2006

(54) GRANULE DISHWASHING APPARATUS AND METHOD OF USE

(75) Inventor: Bertil Rogmark, Vintriegarden, Vintrie (SE) 218 45

(73) Assignee: Bertil Rogmark, Vintrie (SE)

( * ) Notice: Subject to any disclaimer, the term of this patent is extended or adjusted under 35 U.S.C. 154(b) by 122 days.

(21) Appl. No.: 10/459,264

(22) Filed: Jun. 11, 2003

(65) Prior Publication Data

US 2003/0199231 A1 Oct. 23, 2003

Related U.S. Application Data

(60) Division of application No. 09/899,781, filed on Jul. 5, 2001, now Pat. No. 6,609,960, which is a continuation of application No. 09/292,447, filed on Apr. 15, 1999, now Pat. No. 6,280,301.

(30) Foreign Application Priority Data

Apr. 17, 1998 (SE) ..... 9801343
May 26, 1998 (SE) ..... 9801836

(51) Int. Cl.
*B24C 9/00* (2006.01)

(52) U.S. Cl. ..... 451/88; 451/89; 451/99; 451/447

(58) Field of Classification Search ..... 134/176, 134/179, 183; 451/38, 39, 40, 87, 88, 99, 451/446, 447
See application file for complete search history.

(56) References Cited

U.S. PATENT DOCUMENTS 3,455,062 A * 7/1969 Eppler ..... 451/88
3,553,895 A * 1/1971 Power ..... 451/87
3,716,946 A 2/1973 Graf
4,374,443 A * 2/1983 Mosell ..... 15/3
4,744,181 A 5/1988 Moore et al.
4,801,333 A 1/1989 Mosell
5,035,089 A 7/1991 Tillman et al.
5,131,419 A * 7/1992 Roberts ..... 134/50
5,468,175 A 11/1995 Nilen
5,601,480 A 2/1997 Nilen
5,667,431 A 9/1997 Mortin
5,735,730 A * 4/1998 Jonemo et al. ..... 451/87
5,827,114 A * 10/1998 Yam et al. ..... 451/75
6,280,301 B1 8/2001 Rogmark
6,609,960 B1 * 8/2003 Rogmark ..... 451/88

* cited by examiner

*Primary Examiner*—Timothy V. Eley
(74) *Attorney, Agent, or Firm*—Morrison & Foerster LLP

(57) ABSTRACT

A granule dishwashing apparatus with at least one removable granule collector and method of use. The dishwashing apparatus may include a treatment chamber, a tank, one or more granule collectors and one or more pumping devices. Soiled articles are placed in the treatment chamber to be washed with a mixture of liquid and granules that is sprayed at the articles under high pressure. The mixture falls toward the tank after impacting the articles, passing through the granule collector(s). A liquid only portion is separated from the mixture using the granule collector(s) so that the articles can be rinsed. At any point following a cleaning cycle, the granule collector(s) can be removed to add more granules and to simplify the cleaning of the apparatus. The granule collectors may be connected to actuators so that they can be placed in a release mode or a collect mode depending on the function desired.

18 Claims, 10 Drawing Sheets

GRANULE DISHWASHING APPARATUS AND METHOD OF USE

CROSS-REFERENCE TO RELATED APPLICATIONS

This application is a division of application Ser. No. 09/899,781, filed Jul. 5, 2001, now U.S. Pat. No. 6,609,960, which is a continuation of application Ser. No. 09/292,447, filed Apr. 15, 1999, now U.S. Pat. No. 6,280,301, which claims the benefit of Swedish patent applications SE 9801343, filed Apr. 17, 1998, and SE 9801836, filed May 26, 1998. This application expressly incorporates by reference the entirety of each of the above-mentioned applications as if fully set forth herein.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

The present invention relates generally to a cleaning machine and, more specifically, to a dishwashing apparatus and method of use that utilizes a mixture of liquid and granules to clean soiled articles, and includes one or more granule collectors to separate the mixture.

Dishwashing machines, needed to handle high volume and heavily soiled articles, such as in a commercial setting, are well known in the art. It is common practice to mix small, hard particles, such as granules, with water and detergent to achieve an optimal cleaning mixture that is sprayed under high pressure against articles to be washed. Generally, the machines are equipped with a tank, spraying nozzles, and pumps. The liquid or liquid/granule combination is pumped to the nozzles where it is sprayed against articles to be cleaned. After the articles are cleaned, a separation cycle is necessary in order to remove any leftover residue or granules. Thus, a separation method for the granules is essential.

Many prior art references include machines functioning similarly to the above-described process, utilizing various separation methods. For example, U.S. Pat. No. 4,374,443 to Mosell discloses a cleaning machine that uses a liquid-permeable compartment or cassette which either separates or combines the cleaning liquid and granules. This liquid permeable compartment is located inside a liquid container and connects the bottom of a treatment chamber to the liquid container. The liquid permeable compartment communicates with a pump via a valve-controlled opening. Based upon whether the valve-controlled opening is open or closed, either cleaning liquid alone or a slurry of liquid and granules will be drawn by the pump through a suction chamber which is connected to the liquid container. Once the pump has drawn the liquid or the liquid/granule slurry, the fluid alone or slurry will be sprayed through nozzles located in the treatment chamber against goods to be cleaned.

In another patent issued to Mosell (U.S. Pat. No. 4,801,333), a cleaning machine is disclosed that separates granules by using two different levels for liquid and granules. A branch conduit is connected to a bottom outlet and a tank at a position above the surface of a bottom layer of granules below a liquid surface (the granules have a higher density than the liquid). The branch conduit has a float valve at an opening inside the tank and a closure valve between the bottom outlet and the position where the two conduits meet. When the closure valve is opened, the pump will draw from the tank through the bottom conduit, drawing liquid and granules to blast the soiled articles in a treatment chamber. When the closure valve is closed, the pump will draw liquid from the tank through the branch conduit and liquid only will be supplied for rinsing the cleaned articles.

U.S. Pat. No. 5,468,175 to Nilén discloses another way of separating granules in a cleaning machine. The granules are separated by a dividing wall with a pivoting portion at the wall base. The dividing wall separates the tank into two chambers, one with liquid only and the other with liquid and granules. The pivoting arm seals against the tank to prevent granules from passing when closed, and when opened allows granules to pass along with the liquid into the pump, to be recirculated through the system. A different type of separation system was also disclosed by Nilén in U.S. Pat. No. 5,601,480. In this design, separation of granules is done by a separation plate that extends some distance up from the bottom. This separates the tank into two chambers, a small, liquid only chamber and a larger liquid and granule chamber. A second perforated plate may also be attached to the top of the liquid chamber to insure that no granules pass through. Two pumps are required for this system, one connected to each chamber. Depending on the desired make-up of the substance to be sprayed (liquid only or a liquid/granule mixture), each pump is turned on independently.

In U.S. Pat. No. 5,667,431 to Mortin, yet another type of separation device is disclosed. The separation in this patent is done by separating the holding tank into two sections. The first section has a strainer at the bottom that allows the granules to pass into a conduit which is attached to a pump. If water gets too high in the first section it will spill over to the other section. Because the density of the granules is greater than the density of water, the overflow will theoretically contain liquid only. This second, liquid only section also has a conduit which is attached to a pump. Both pumps carry the liquid or liquid/granule mixture to a nozzle arrangement where they are sprayed against the articles to be cleaned. Alternatively, if the density of the granules is less than the water, a separate embodiment contemplates a system where the passage is at the bottom of the tank and the supply means is located in the upper portion.

Finally, U.S. Pat. No. 5,735,730 to Jonemo et al. discloses a dishwasher that uses a valve separation device to separate the granules from the liquid. The granule valve has a socket open at each end, and is associated with a bottom outlet. The socket is guided for vertical displacement between the upper position, with an opening at the lower end of the socket for drawing liquid with granules entrained therein by a pump from a treatment space at a lower level, and a lower position with the opening at the lower end of the socket closed for drawing liquid only by the pump from a higher level at the upper end of the socket. A projecting circumferential flange is provided on the socket below the upper end of the socket forming together with a cap that is located over the socket, a seal for preventing granules from being withdrawn along with the liquid.

While the prior art cleaning machines separate granules from liquids in a variety of ways, all are very difficult to clean at the end of a working shift. This can be largely attributed to the fact that the granules remain in the tank after the cleaning cycle, gravitating around the separation devices. Thus, cleaning the bottom of the tank becomes laborious. In view of the increasing demands from users for improved hygienic properties in the cleaning machines, a need exists to develop a cleaning machine which will collect the granules in an efficient manner so they can be removed for cleaning of the machine. In addition, removal of the granules is advantageous because the amount of granules can be monitored so that granules can be added when necessary to ensure that articles are consistently subjected to optimal cleaning conditions.

It is therefore an object of this invention to provide a granule dishwashing apparatus that is easy to clean at the end of a wash cycle. It is another object of this invention to provide a granule dishwashing apparatus that utilizes granule collectors to separate granules from liquid. It is still a further object of this invention to provide granule collectors in a granule dishwashing apparatus that are easy to install and remove. It is yet another object of this invention to provide a granule dishwashing apparatus that is easy to use and inexpensive to produce.

BRIEF SUMMARY OF THE INVENTION

In accordance with the teachings of the present invention, a granule dishwashing apparatus with at least one removable granule collector and method of use is provided. The present invention encompasses a complete system for heavy-duty cleaning of articles, which is useful, for example, in a commercial environment. This system includes a treatment chamber for cleaning soiled articles, nozzles to spray liquid or a liquid/granule mixture against the articles, a pump or pumps to carry the liquid or liquid/granule mixture through the machine, and granule collectors to separate the granules from the liquid and to provide an easy way to remove the granules from the apparatus.

In a first embodiment of the invention, the granule dishwashing apparatus comprises one pump and piping system along with two granule collectors side-by-side, cleaning goods by using either a cleaning liquid entrained with granules ("the slurry") or liquid only. This embodiment also includes a treatment chamber in which goods to be cleaned are stored in a washing rack. Nozzles in the treatment chamber spray a cleaning agent against the articles in the washing rack. The cleaning agent, which is pumped from a collection tank below the treatment chamber, may be either a cleaning fluid only or the slurry.

When the cleaning agent has impacted the goods, it forms a return flow which travels downward from the treatment chamber and is received by a tank below the chamber. The tank and treatment chamber form a single contiguous space within the dishwashing machine. Granule collectors are positioned side-by-side either in the tank or in the treatment chamber where they can receive the return flow. Assuming that the cleaning agent consists of the slurry, the granule collectors can either collect and separate the granules from the cleaning fluid or allow the granules to travel unimpeded with the cleaning liquid. Once the return flow has passed the granule collectors, it enters a conduit connected to the bottom of the tank. A pump draws the return flow through the conduit and pumps it back to the nozzles to be sprayed against the goods once again.

The granule collectors are discrete units, separate from the walls of the treatment chamber and the tank, and are removably and rotatably mounted in the machine. The granule collectors are coupled to actuators located outside of the machine. The actuators facilitate the two modes of operation for the granule collectors: collection and release. In the collection mode, the granule collectors are positioned by the actuators to "catch" the return flow in order to separate and collect the granules from the slurry. By catching the granules, the collectors allow the cleaning liquid alone to pass to the bottom of the tank and to be drawn by the pump and ejected through the nozzles. When the collectors are in the release mode, they do not catch the return flow. Thus, the return flow travels directly to the bottom of the tank and can be drawn by the pump through the conduit. In addition, in the release mode, granules previously collected by the collectors will be reintroduced to the return flow.

The granule collectors of the dishwashing machine allow the machine to be operated using a liquid only cleaning agent. This is advantageous for several reasons. First, for lightly soiled goods, a liquid only cycle may be desired. The collectors ensure that only liquid is ejected by the nozzles and circulated through the system. Second, at the end of the day, it is highly desirable to clean the dishwashing machine. Collection of the granules by way of the granule collectors greatly facilitates the cleaning task. Third, the granule collectors enable the operator to quickly and easily monitor the amount of granules remaining in the cleaning machine. A visual inspection of the granules captured in the collectors enables the operator to readily determine if there are sufficient granules or whether more granules should be added to the machine. Because the granule collectors are removable, this task can be accomplished quickly and efficiently.

In the preferred embodiment, the granule collector is formed of a basket having a bottom, side walls and end walls. Some or all of the walls of the collectors may be perforated. If a collector is in the collection mode and its walls are perforated, the liquid in the return flow passes through the perforations in the walls. Alternatively, if the walls are not perforated, the liquid initially collects in the collector, but when the volume of the liquid exceeds that of the collector, the liquid simply overflows the rims of the collector. The release mode for the collectors involves the rotation of the granule collectors onto their sides so that the return flow from the treatment chamber mostly bypasses them and travels unimpeded to the conduit at the bottom of the tank.

A second embodiment of the invention is also a cleaning machine that cleans goods by using a cleaning agent, which may be either a cleaning liquid entrained with granules ("a slurry") or fluid only. However, in the second embodiment, there are two pumps utilized and the granule collection process involves only one collector. Moreover, the second machine can be smaller, for less voluminous uses, than the first. The second embodiment, like the first, includes a treatment chamber in which goods to be cleaned are stored in a washing rack. Nozzles in the treatment chamber spray the cleaning agent against the goods in the washing rack, and the cleaning agent is stored in and pumped from a collection tank located below the treatment chamber. When the cleaning agent has impacted the goods, it forms a return flow which travels downward from the treatment chamber and is received by the collection tank. The tank and treatment chamber form a single contiguous space within the dishwashing machine.

Assuming that the return flow is a slurry of fluid and granules, this embodiment utilizes a removable, basket-like granule collector to collect and separate granules from the cleaning fluid. During the machine's operation, however, the collector is stationary; that is, the device is always in a granule collection mode. The collector of the machine is located near the bottom of the collection tank and has perforated walls that permit liquid in the return flow to pass through them. Because the granule collector sits above the bottom of the tank, the collector segregates a portion of the tank below it. The portion of the collection tank below the granule collector contains cleaning fluid only and is thus granule-free. The bottom of the collector has a hole through which a primary conduit extends upwards into the collector and a deflector is located above this hole. When the collector is correctly positioned in the collection tank, the primary conduit extends upward through the hole in the bottom of the collector and terminates below the deflector. The deflector prevents granules in the return flow from falling directly into the primary conduit and displaces them to the bottom or sides of the granule collector.

The primary conduit is connected to a primary pump which in turn is connected to a primary set of nozzles in the treatment chamber. When the goods are to be cleaned with a slurry, the primary pump is activated, drawing granules from the granule collector together with cleaning liquid through the primary conduit in the tank. The primary pump discharges this slurry against the goods in the treatment chamber. The collector catches the return flow, filtering and collecting granules from the flow, and permitting liquid to pass through the perforations in its walls and collect in the tank.

When cleaning fluid alone is to be discharged against the goods, the primary pump system is disabled, and a secondary pump system which includes a secondary set of nozzles, pump and conduit is employed. A secondary conduit is connected to the portion of the tank below the granule collector. A secondary pump is connected to the secondary conduit as well as to a secondary set of nozzles in the treatment chamber. When the secondary pump is activated, it withdraws liquid only from the tank below the granule collector and sprays the fluid through the secondary nozzles against the goods stored in the treatment chamber.

A more complete understanding of the granule dishwashing technology of the present invention will be afforded to those skilled in the art, as well as a realization of additional advantages and objects thereof, by a consideration of the following detailed description of the preferred embodiments. Reference will be made to the appended sheets of drawings that will first be described briefly.

DETAILED DESCRIPTION OF THE INVENTION

The following detailed description should be read with reference to the drawings, in which like elements in different drawings are identically numbered. The drawings, which are not necessarily to scale, depict selected preferred embodiments and are not intended to limit the scope of the invention. The detailed description illustrates by way of example, not by way of limitation, the principles of the invention. This description will clearly enable one skilled in the art to make and use the invention, and describes several embodiments, adaptations, variations, alternatives and uses of the invention, including what is presently believed to be the best mode of carrying out the invention.

The present invention satisfies the need for a granule cleaning machine in which the granules are removable for cleaning and counting purposes. This is accomplished by the granule dishwashing apparatus of the present invention which utilizes removable granule collectors to quickly and easily remove granules at the end of a cleaning cycle so that the machine can be cleaned and additional granules can be added for consistency.

Figure 1:
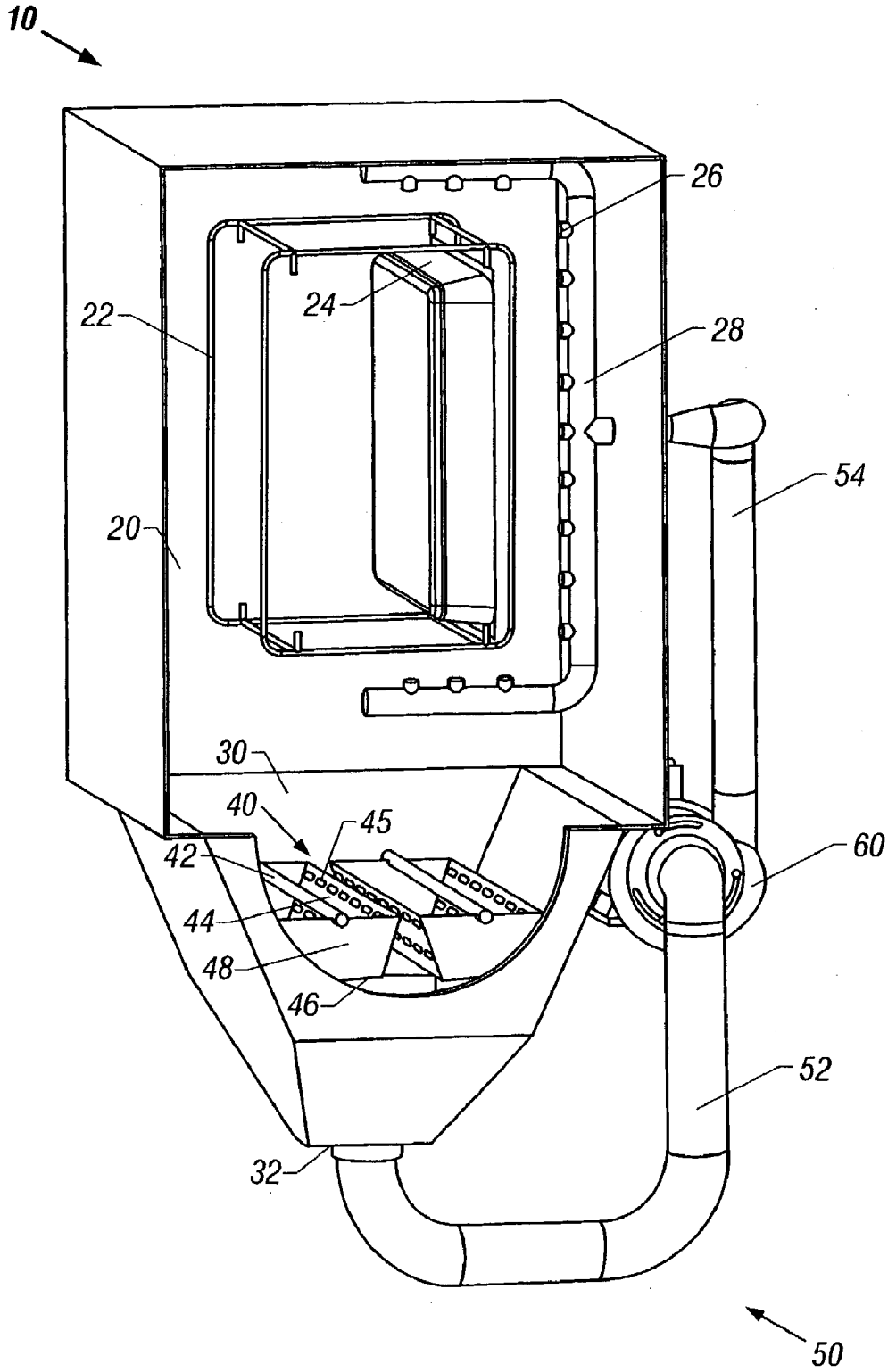
FIG. 1. is a front perspective view of a first embodiment of the present invention with granule collectors in a closed position.

Referring now to FIG. 1, a first embodiment of the granule dishwashing apparatus 10 is shown. Dishwashing apparatus 10 consists primarily of a treatment chamber 20, a tank 30 located below the treatment chamber 20, and a conduit 50 that exteriorly connects the tank 30 to the treatment chamber 20. The treatment chamber 20 contains washing rack 22 where soiled articles 24 are hung or supported in some manner to be cleaned. Numerous nozzles 26 are coupled to discharge pipe 28. Discharge pipe 28 wraps a portion of the way around washing rack 22 so that nozzles 26 point in a direction facing articles 24. Discharge pipe 28 as well as nozzles 26 are of sufficient size so that both liquid and granules can pass at an accelerated rate. Below treatment chamber 20, tank 30 is positioned to funnel all of the liquid and granule mixture that has impacted articles 24, i.e. the return flow, toward tank outlet 32. Treatment chamber 20 and tank 30 flow continuously into one another.

Granule collectors 40 are disposed between washing rack 22 and tank outlet 32. The granule collectors 40 can be disposed within tank 30 or near the bottom of treatment chamber 20. Moreover, any number of granule collectors 40 can be assembled inside of tank 30. One can envision a configuration involving multi-tiered collectors or numerous collectors on one level to substantially cover the surface area of the portion of the machine in which they sit. As shown in FIG. 1, however, two granule collectors are located in tank 30. Granule collectors 40 are positioned side-by-side inside of tank 30 so that the majority of the return flow passes through the collectors 40 before continuing downward to the tank outlet 32. Each granule collector 40, as shown in FIG. 1, includes two side walls 44, a bottom 46, and two end walls 48. As shown in FIG. 1, the side walls 44 have perforations 45 that are sized to restrict the passage of the granules, but allow the passage of liquid (in other embodiments, the bottom and end walls could also be perforated). Alternatively, the granule collectors 40 could be constructed with no perforations so that as the return flow would fall into the collectors 40, the liquid would spill over the sides as the granules remained inside due to the greater density of the granules.

Figure 2:
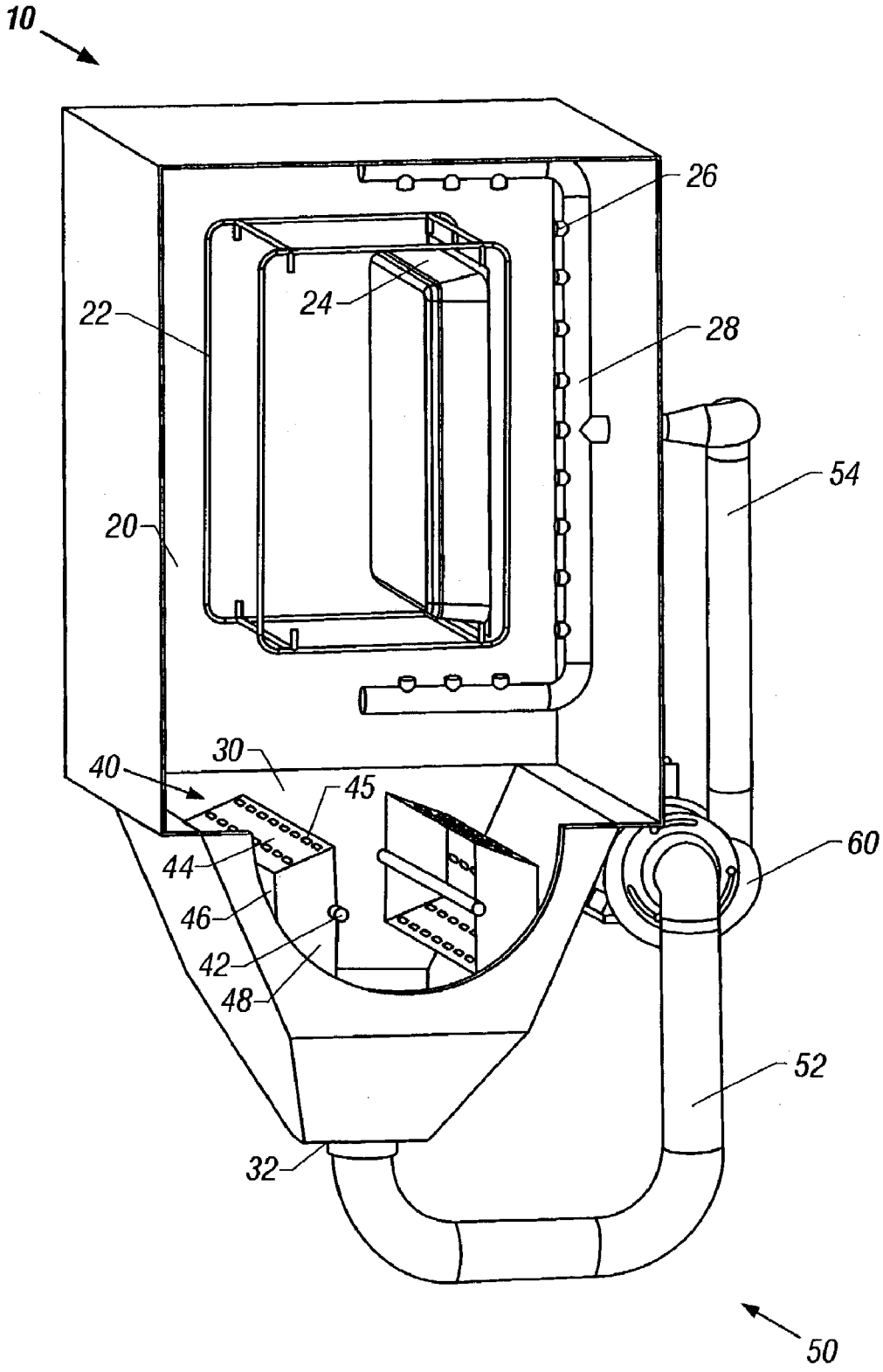
FIG. 2 is identical to FIG. 1 with the exception that the granule collectors are in an open position.

In either case, as shown in FIG. 1, the granule collectors are trapezoidal in shape with an open top side to allow flow of the mixture into the granule collectors 40. The granule collectors 40 are mounted on shafts 42 which can be externally manipulated by various types of actuators (not shown), including those which are electrically and hydraulically powered. The actuators rotate the granule collectors 40 between different positions depending on the function desired. In the open position, as shown in FIG. 2, the granule collectors 40 are in a release mode and are turned sideways by the actuators so that the open portions of the collectors 40 are facing to the side of tank 30. In this position, granules are allowed to pass by the collectors 40 without impedance to the tank outlet 32. In the closed position, shown in FIG. 1, the granule collectors 40 are in a collect mode wherein a substantial amount of the return flow passes through the collectors 40 before continuing down toward tank outlet 32.

The liquid portion of the mixture leaks through perforations 45, leaving the granules inside of the collectors 40. After several washing cycles, most of the granules are collected by the granule collectors 40. The granule collectors 40 are removably mounted in the dishwashing apparatus 10 so that they are easily removed from the tank 30. As seen in FIGS. 1 and 2, the granule collectors 40 are coupled to shafts 42 and are removable from the shafts at the end of a cleaning cycle. Alternatively, it is possible to envision a configuration in which a shaft portion is a part of the granule collector. In this alternate configuration, the shaft of the granule collector could fit into a hole in the back of the tank 30 and snap into a clutch assembly on the front of the tank, attached to the actuator. Once the collectors 40 are removed, the dishwashing apparatus 10 can be cleaned and those granules that were lost due to erosion can be replaced.

Directly coupled to the tank outlet 32 is a return flow conduit 50. This conduit 50 is the means by which the return flow is sent back to the nozzles 26 to be re-circulated through the system. Return flow conduit 50 consists of a lower conduit 52, which receives the return flow from the tank, and an upper conduit 54, which transports the return flow to the discharge pipe 28. Connecting the lower conduit 52 to the upper conduit 54 is pump 60 which acts to pull the return flow from the lower conduit 52, transferring it to upper conduit 54 at an accelerated rate for spraying through nozzles 26.

Figure 3:
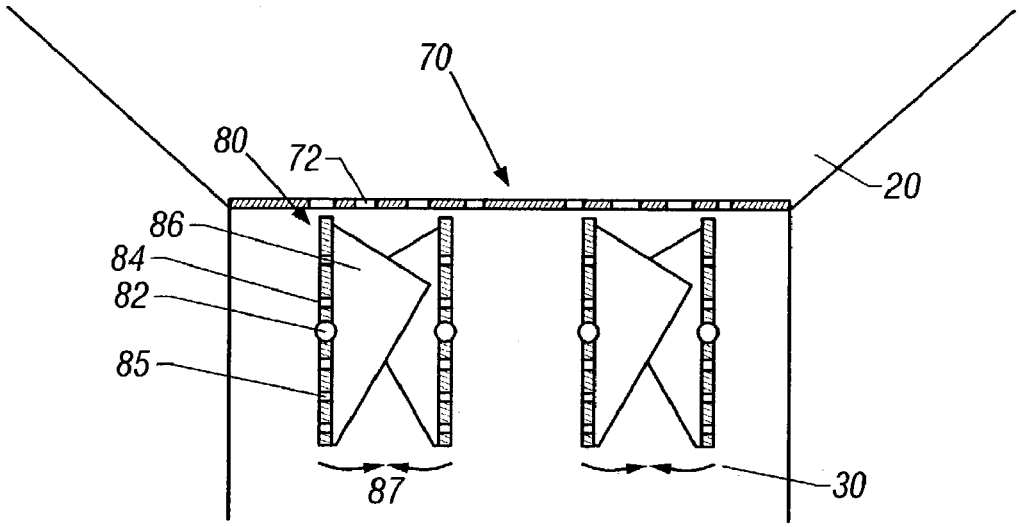
FIG. 3 is a schematic side view of a variation of the granule collectors in an open position.
Figure 4:
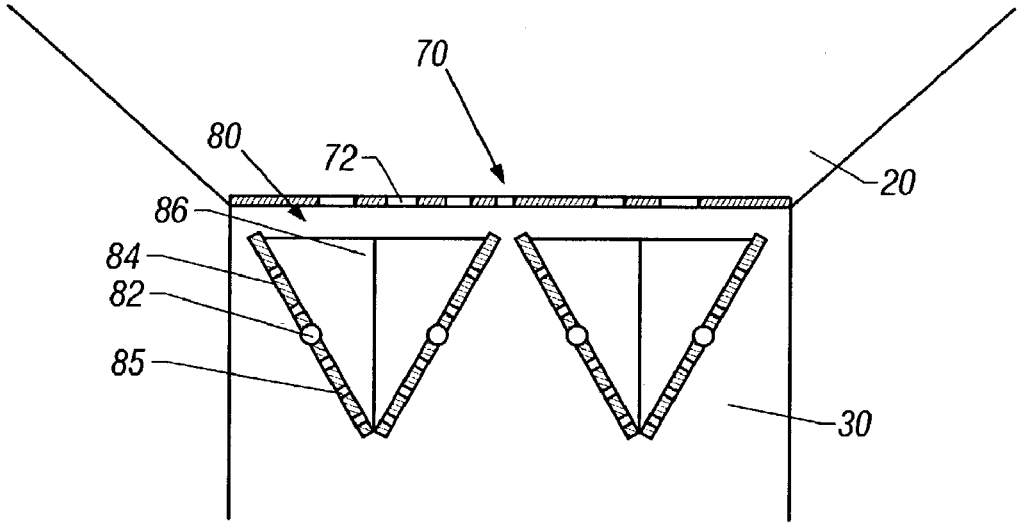
FIG. 4 is a schematic side view of the granule collectors in FIG. 3 in a closed position.

FIG. 3 shows a variation of the granule collectors to be used in dishwashing apparatus 10. Granule collectors 80 are shown in the open position, or release mode. In this embodiment, two opposing side walls 84 of the granule collectors 80 are pivotally arranged on shaft 82. The side walls 84 are formed with perforations 85, which restrict the passage of granules, but permit passage of liquid. Granule collectors 80 also have a rear gable wall 86 and an opposing front gable wall (not shown). The granule collectors 80 in FIG. 3 allow passage of the liquid and granule mixture without impedance. FIG. 4 shows the granule collectors 80 of FIG. 3 in the closed position, or collect mode. By pivoting the side walls 84 together to form a V, as indicated by arrows 87, a basket-like structure is created consisting of two side walls 84, a rear gable end 86 and an opposing front gable end. The granules are accumulated inside granule collectors 80 in this configuration, while return flow liquid is allowed to seep through perforations 85. As in the embodiment shown in FIG. 1, granule collectors 80 are also coupled to actuators for positioning in the release mode or collect mode. In addition, they are easily removable from the dishwashing apparatus 10.

Both FIGS. 3 and 4 also show a flow director 70, which is made of a coarse screen or similar device, that is used to protect the granule collectors 80 from a direct impact of the return flow. This may become necessary due to the vigorous nature of the return flow which could force already collected granules out of the granule collectors 80. The flow director 70 has a plurality of granule openings 72. The size and location of the granule openings 72 will allow granules to pass through the flow director 70 and into the granule collectors 80. Thus, the granule collectors 80 will be filled with granules faster and granules will not be washed away.

Figure 5:
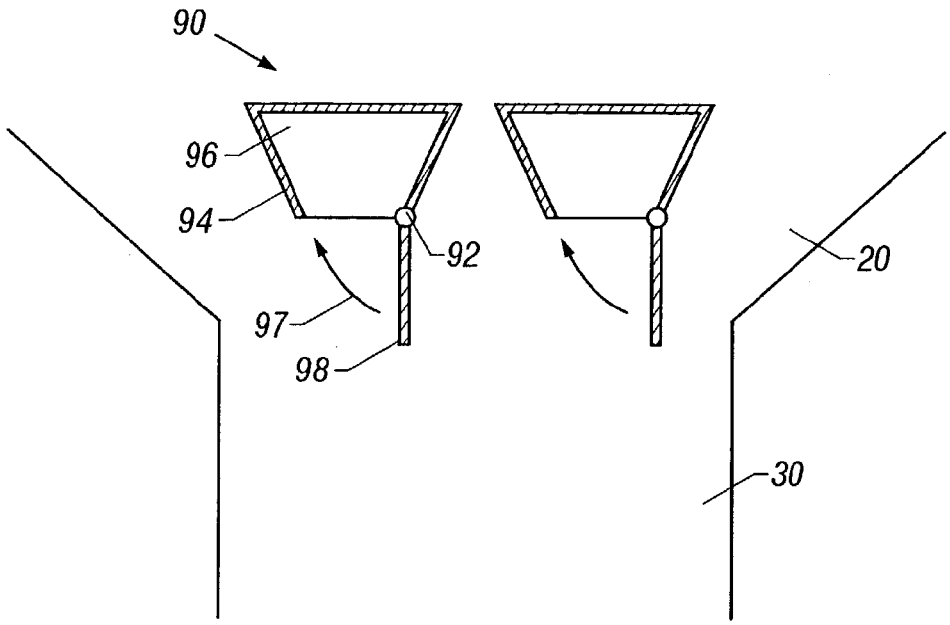
FIG. 5 is a schematic side view of a second variation of the granule collectors in an open position.
Figure 6:
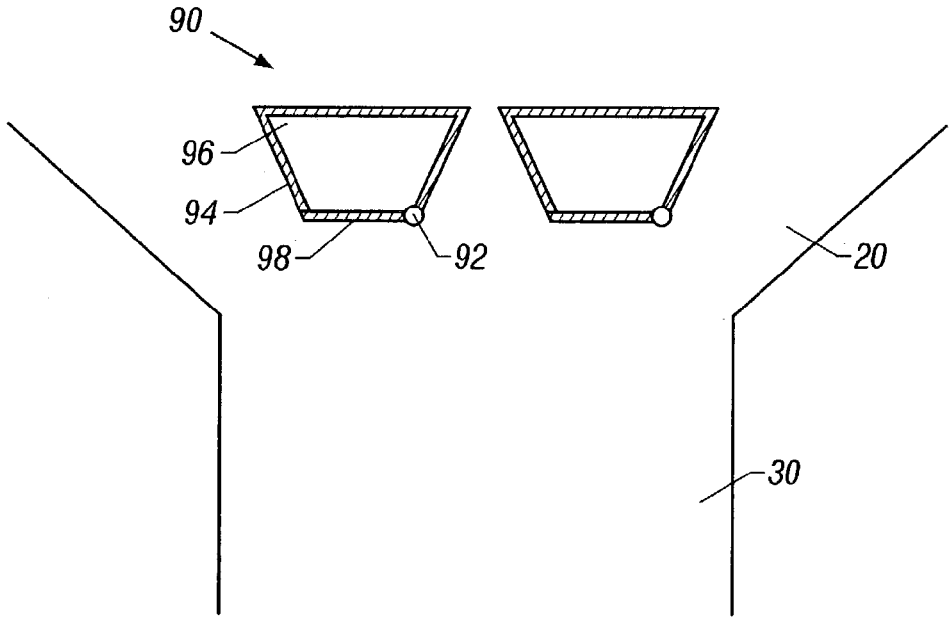
FIG. 6 is a schematic side view of the granule collectors in FIG. 5 in a closed position.

FIG. 5 illustrates a second variation of the granule collectors to be used in dishwashing apparatus 10. Granule collectors 90 are shown in the open position, or release mode. In this embodiment, granule collectors 90 are trapezoidal in shape and are disposed in treatment chamber 20 as opposed to tank 30. Granule collectors 90 consist of side walls 94, rear gable end 96, front gable end (not shown) and a pivotable bottom 98. The bottom 98 is pivoted between open and closed positions through the use of pivot pin 92. An actuator (not shown) is attached to pivot pin 92 to open and close granule collector 90. FIG. 6 shows the granule collectors 90 of FIG. 5 in a closed position. The bottom 98 is pivoted in the direction shown by arrows 97. Once in the closed position, or collect mode, the granules will be collected inside of the granule collectors 90 as the liquid either overflows and spills out of the top, or seeps through perforations provided in side walls 94.

It should be noted that it is not necessary to direct the total return flow into the granule collectors in the first embodiment. Although this would accelerate the separation process, the present invention provides a satisfactory result even if only some fraction of the return flow actually passes through the granule collectors. The reason for this is that the main pumping device 60 circulates the total tank volume so many times during a normal separation period that practically all of the granules will be collected. Moreover, the time cycle used depends on the nature of the articles to be cleaned. For instance, a longer time cycle of 6 minutes, consisting of washing with a mixture of liquid (water and detergent) and granules for 4 minutes, separating granules from the water for 1 minute and rinsing with clean hot water for 1 minute, would be used for articles that are heavily soiled. On the other hand, a shorter cycle of 3 minutes, wherein a mixture of liquid and granules are used to wash for 1.5 minutes, separating occurs for 0.75 minutes, and rinsing finishes the cycle for 0.75 minutes, is used for lightly soiled articles. Also, the hot water used for the rinsing cycle can be mixed with a rinse agent that reduces surface tension and thus prevents marks from drying drops and generally speeds up uniform drying.

Figure 7:
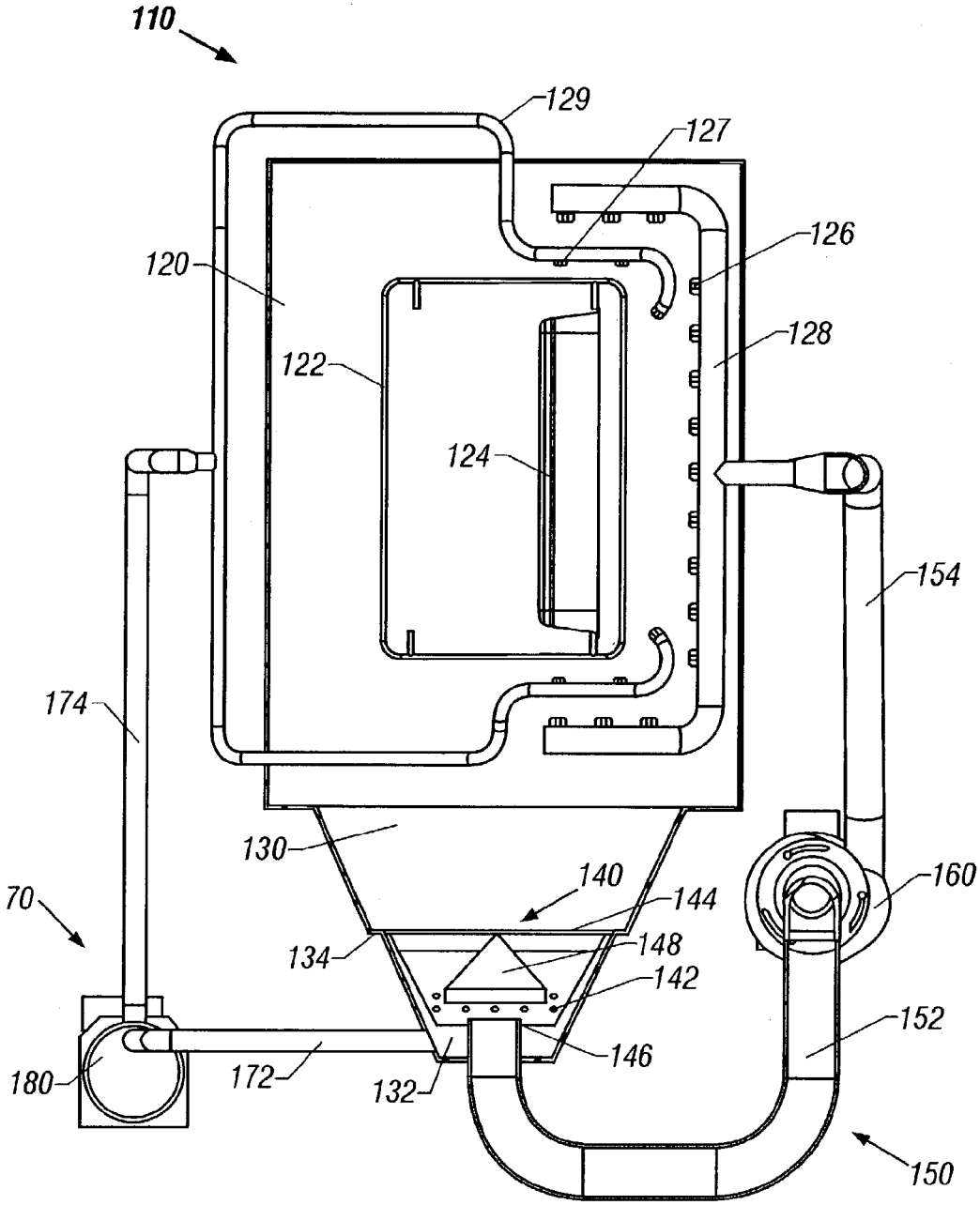
FIG. 7 is a sectional view of a second embodiment of the present invention.
Figure 8:
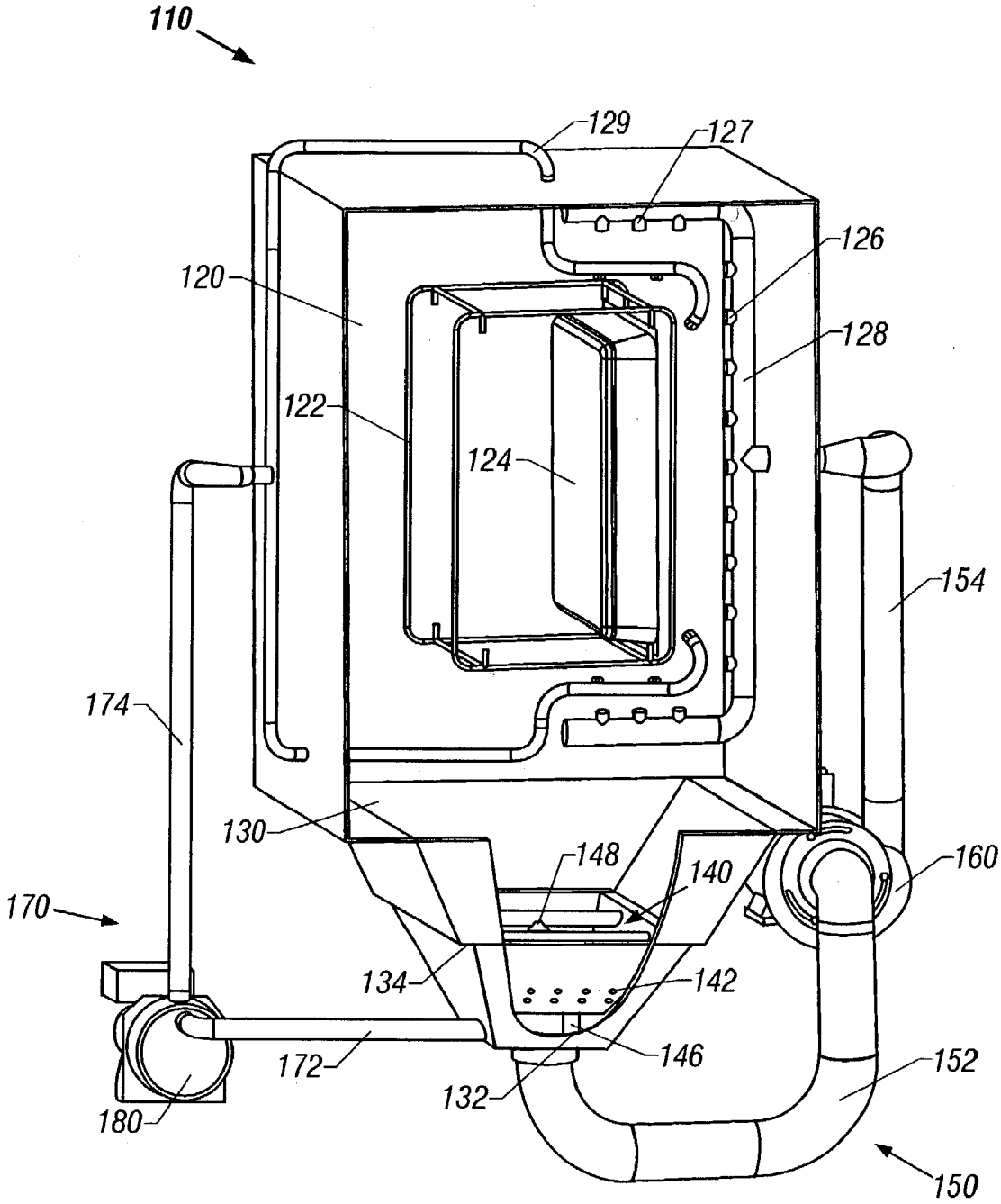
FIG. 8 is a perspective view of the device according to FIG. 7.

A second embodiment of the present invention is illustrated in FIGS. 7–12, contrasting with the first embodiment in the fact that two separate conduits are used along with two pumps and two discharge pipes. Also, only one granule collector is used as opposed to multiple collectors as in the first embodiment. Moreover, the second embodiment can be a smaller machine for applications that require less frequent or less voluminous use. The smaller machine can also have two settings, one for delicate articles such as glass and porcelain, and one for harder to clean articles such as pots and pans. In FIGS. 7 and 8, dishwashing apparatus 110 is shown, consisting of a treatment chamber 120, a tank 130, granule collector 140, primary conduit 150 and secondary conduit 170. The treatment chamber 120 contains washing rack 122 where soiled articles 124 are hung or attached in some manner to be cleaned. Two discharge pipes 128 and 129 are positioned along the outside of washing rack 22. Primary discharge pipe 128, with nozzles 126 attached thereto and facing the articles 124 on washing rack 122, is equipped to handle a mixture of granules and liquid for the cleaning sequences. Secondary discharge pipe 129, on the other hand, is smaller in diameter, as are its nozzles 127, and is used for the spraying of liquid only. Tank 130 is located below treatment chamber 120 and acts to funnel the return flow through granule collector 140, located near the bottom of tank 130, for passage through primary conduit 150. As in the first embodiment described above, treatment chamber 120 and tank 130 form a single contiguous space.

Granule collector 140 is disposed near the bottom of tank 130, resting on ledge 134 such that a space 132 is created below it. This alignment makes removal of granule collector 140 from dishwashing apparatus 110 fast and easy at the end of a cleaning cycle. Granule collector 140 is trapezoidal in shape and forms a basket-like structure such that a top side 144 that faces treatment chamber 120 is open for receiving the return flow and covers substantially all of the surface area of the portion of the tank in which it lies. One or all of the sides of granule collector 140 can be perforated with perforations 142 to allow the passage of liquid. Perforations 142 are sufficiently small to prevent the passage of granules, but are large enough to allow the passage of liquid. A primary conduit 150 runs through space 132 and connects to the bottom of granule collector 140 at hole 146. The hole 146 is close enough in diameter to conduit 150 so that granules can not pass there between. A deflector 148 is disposed directly above the hole 146 in the bottom of granule collector 140 to prevent granules from entering conduit 150 when dishwashing apparatus 110 is not in operation and when granule collector 140 is lifted out of dishwashing apparatus 110.

Primary conduit 150 links tank 130 with treatment chamber 120 and consists of lower conduit 152 and upper conduit 154. Lower conduit 152 is coupled to the bottom of granule collector 140 on one end and to an inlet for primary pumping device 160 on the other end. Upper conduit 154 is connected to an outlet of primary pumping device 160 and treatment chamber 120. When dishwashing apparatus 110 is in operation, primary conduit 150 along with primary pumping device 160 transport return flow in the form of a slurry from the granule collector 140 to the discharge pipe 128 for reuse. A secondary conduit 170 is also used in this embodiment, to transfer liquid only from the tank 130 to the treatment chamber 120 to flush any remaining granules off of articles 124 at the end of a cleaning cycle. Secondary conduit consists of a secondary lower conduit 172 and a secondary upper conduit 174, connected by a secondary pumping device 180, which can be much smaller than the primary pumping device 160 because the liquid only return is much less voluminous than the return flow running through primary conduit 150. Secondary lower conduit 172 takes the liquid that seeps through the perforations 142 of granule collector 140 from space 132 below granule collector 140 to secondary pumping device 170. From there, the liquid is pumped through secondary upper conduit 174 to a secondary discharge pipe 129.

Figure 9:
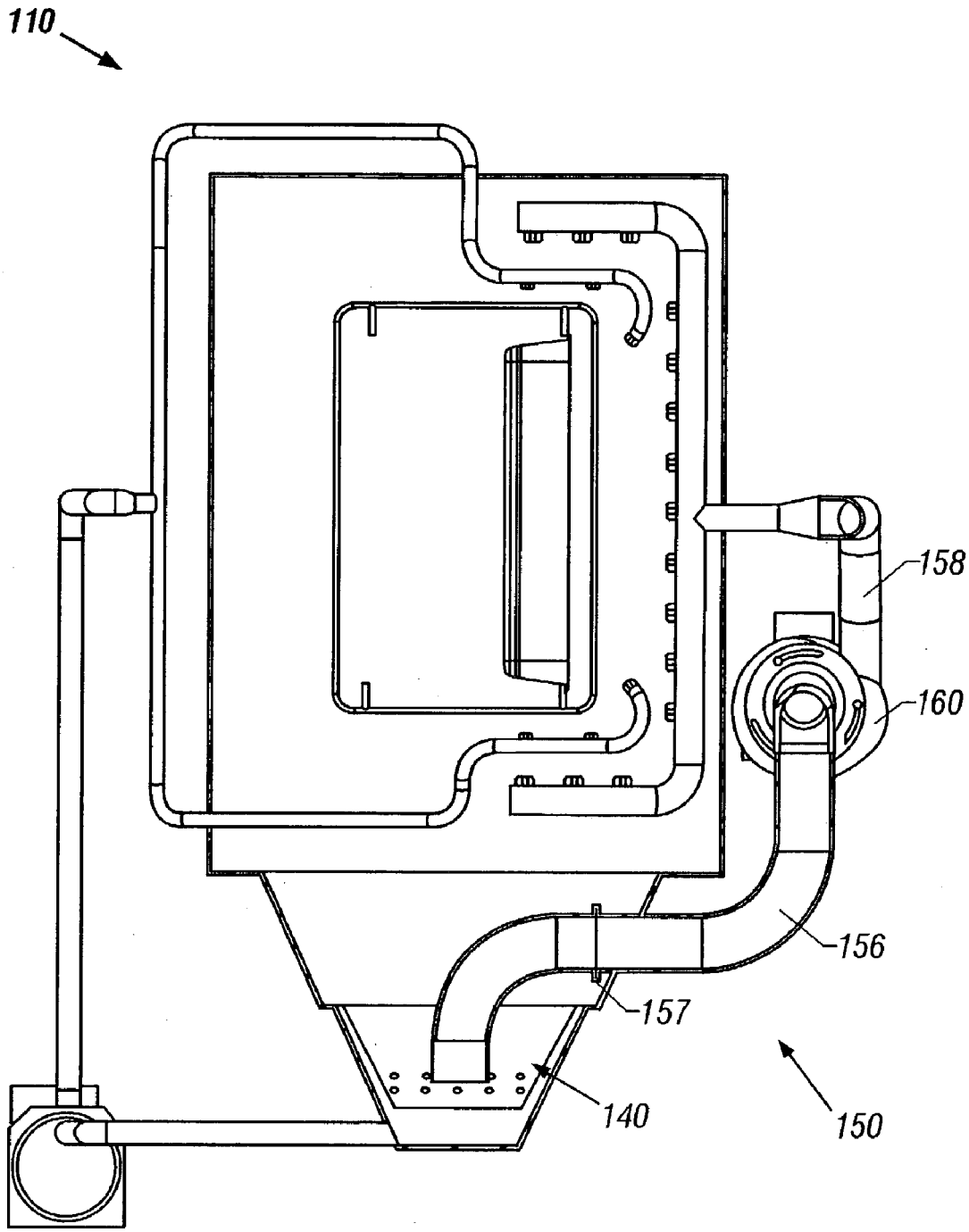
FIG. 9 is a sectional view of a variation of the device according to FIG. 7.
Figure 10:
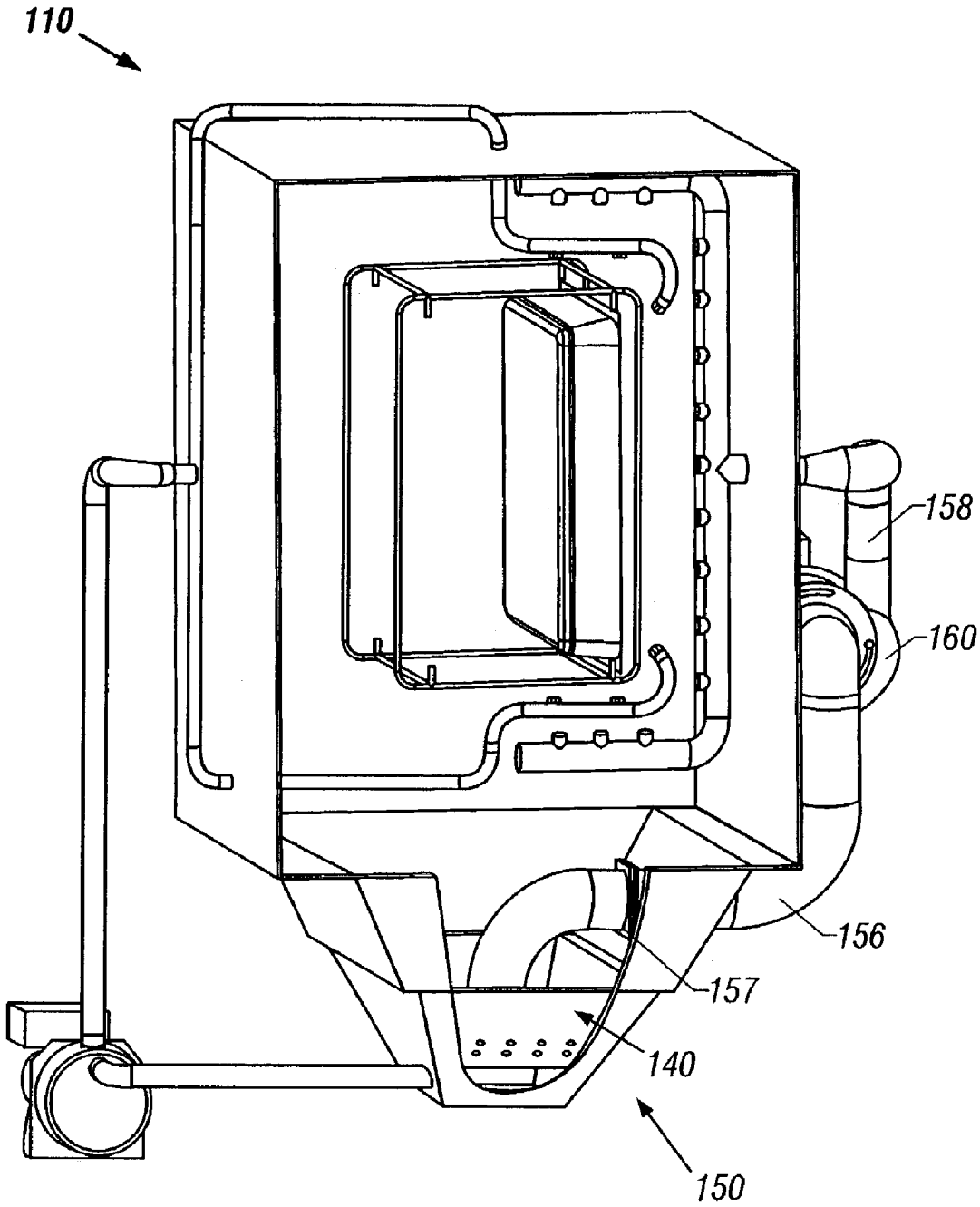
FIG. 10 is a perspective view of the device in FIG. 9.

FIGS. 9 and 10 illustrate a variation of dishwashing apparatus 110. In this design, a suction conduit 156 takes the place of lower conduit 152 of the previous design. Suction conduit 156 feeds into granule collector 140 through top side 144 so that the initial direction of the return flow is upwards. Thus, the deflector 148 of the previous design is not necessary because there is no danger of granules falling into suction conduit 156 at the end of a cleaning cycle. Suction conduit 156 also contains a coupling or joint 157 so that the lower portion of suction conduit 156 can be either removed or swung out of the way for easy removal of granule collector 140. Upper conduit 158 is also different from the design shown in FIGS. 7 and 8 in that it is shorter in length.

Figure 11:
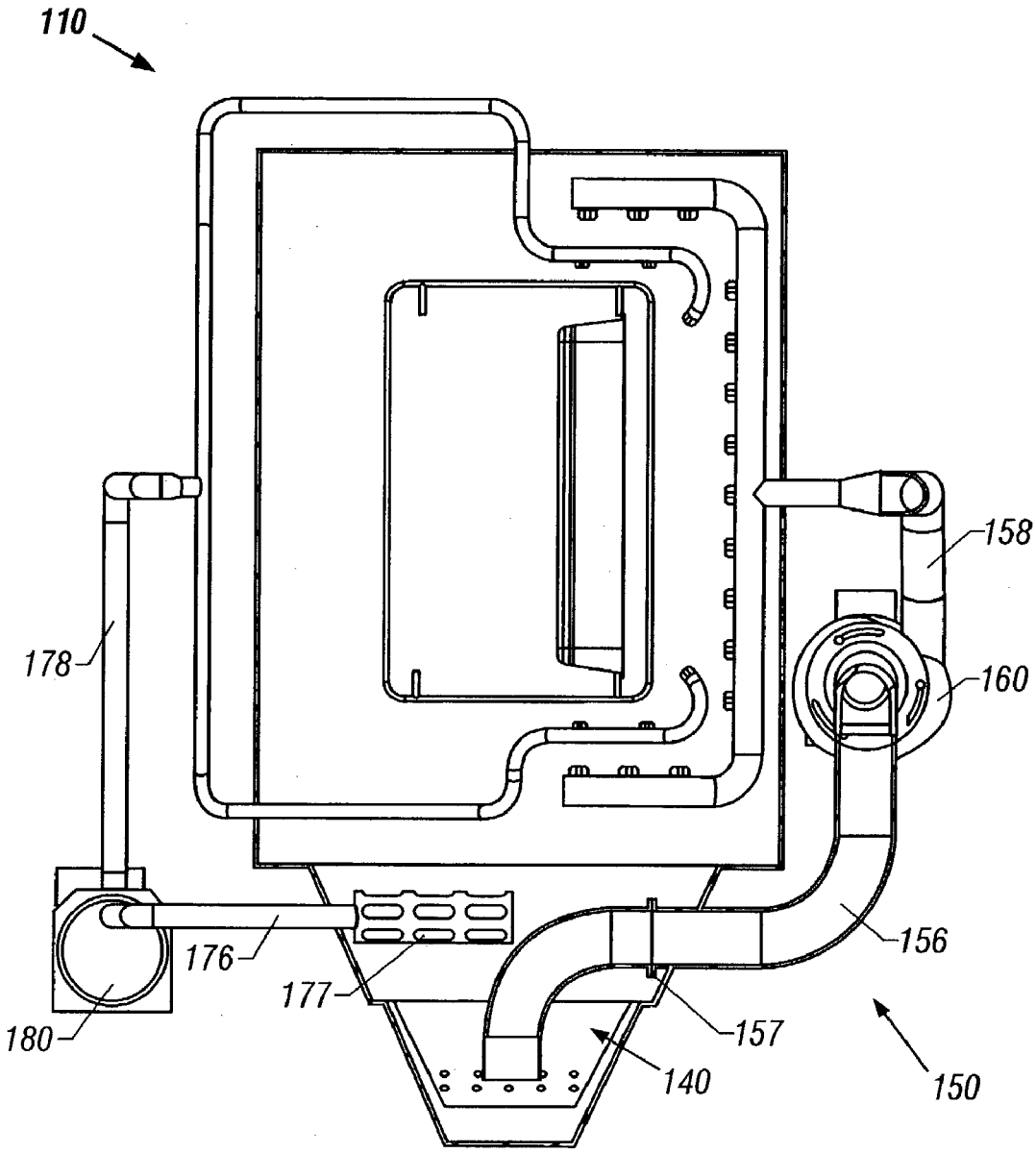
FIG. 11 is a sectional view of a second variation of the device according to FIG. 7.
Figure 12:
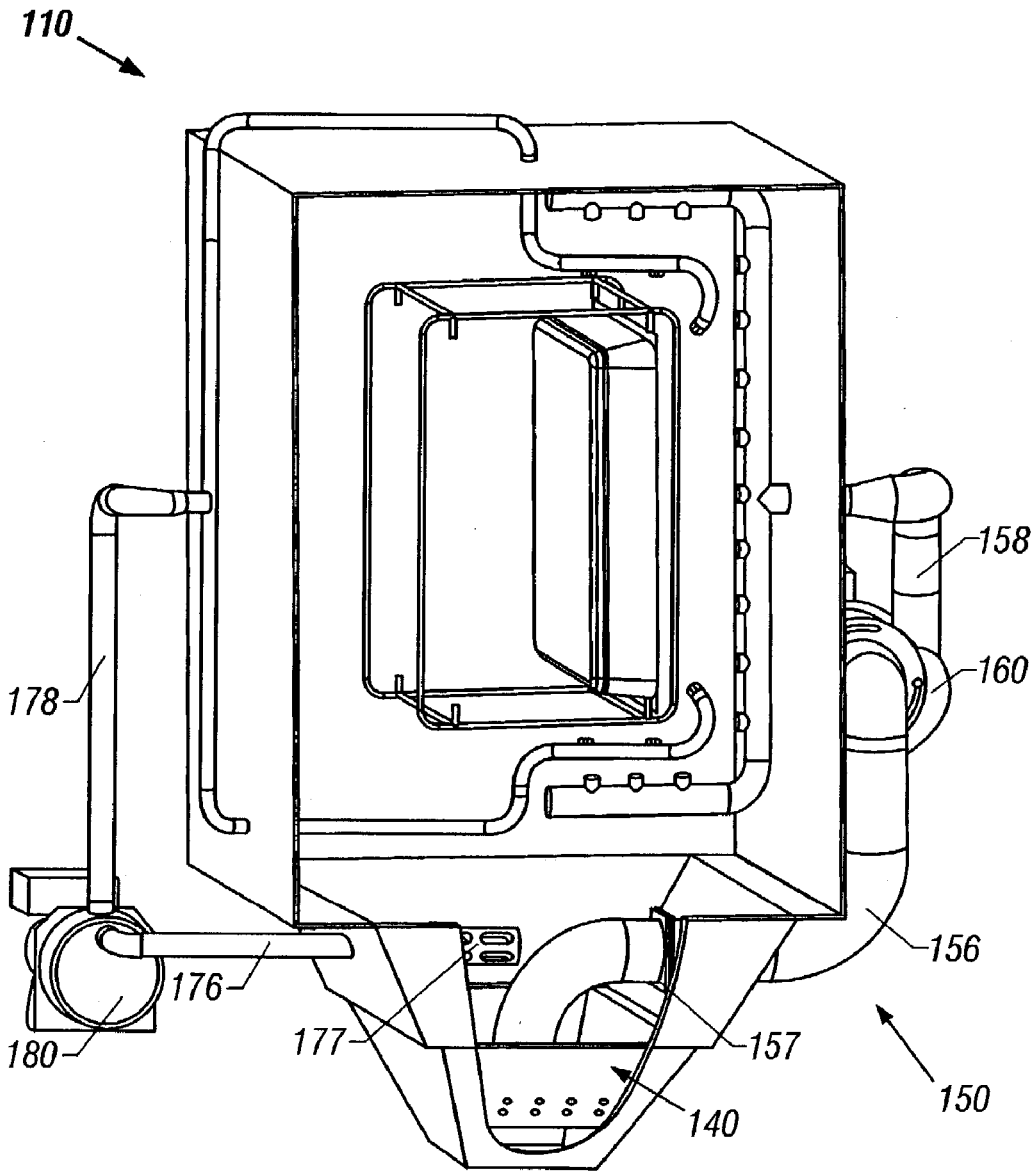
FIG. 12 is a perspective view of the device in FIG. 11.

FIGS. 11 and 12 show a second variation of dishwashing apparatus 110 similar to the first variation except that instead of secondary conduit 172 connecting to the bottom of tank 130 at space 132, liquid is withdrawn from the top of tank 130 through a sieve 177 which is attached to secondary lower conduit 176. The positioning of sieve 177 is such that removal of granule collector 140 is still possible without removal of other components. Secondary upper conduit 178 in FIGS. 11 and 12 takes the place of secondary upper conduit 174 of FIGS. 7–10, but has the same function.

Having thus described preferred embodiments of the granule dishwashing apparatus, it should be apparent to those skilled in the art that certain advantages of the within system have been achieved. It should also be appreciated that various modifications, adaptations, and alternative embodiments thereof may be made within the scope and spirit of the present invention. For example, while one and two collector systems have been illustrated, it should be apparent that the inventive concepts described above would be equally applicable to three or more collector systems. The invention is further defined by the following claims.

What is claimed as new and desired to be protected by Letters Patent of the United States is:

1. An apparatus for washing articles using a cleaning fluid, wherein said cleaning fluid is a mixture of liquid and granules, comprising:

a cleaning chamber;

a washing rack disposed within said cleaning chamber;

a removable granule collector disposed below said washing rack so that said mixture passes through said granule collector; and a conduit connecting a bottom of said cleaning chamber to a top of said cleaning chamber, wherein said conduit re-circulates said mixture by transporting said mixture from said bottom of said cleaning chamber to said top of said cleaning chamber.

2. The washing apparatus according to claim 1, further comprising a second removable granule collector disposed below said washing rack so that said mixture passes through said second granule collector.

3. The washing apparatus according to claim 2, wherein each of said granule collector and said second granule collector comprises a bottom wall, a plurality of side walls and an open top side.

4. The washing apparatus according to claim 3, wherein at least one of said walls is perforated to allow the passage of said liquid, but prevents the passage of said granules.

5. The washing apparatus according to claim 4, wherein each of said granule collector and said second granule collector are disposed near said bottom of said cleaning chamber, wherein substantially all of said mixture from said top of said cleaning chamber passes through said granule collectors, and wherein a space is created between said bottom wall of said granule collectors and said bottom of said cleaning chamber.

6. The washing apparatus according to claim 5, further comprising a secondary conduit, wherein said secondary conduit is connected to said space below said granule collector, wherein said secondary conduit re-circulates said liquid by transporting said liquid from said space to said top of said cleaning chamber.

7. The washing apparatus according to claim 6, further comprising a secondary pumping device and a secondary discharge pipe coupled to said secondary conduit.

8. The washing apparatus according to claim 5, further comprising a secondary conduit, wherein said secondary conduit is connected to said cleaning chamber above said granule collector, wherein said secondary conduit further comprises a sieve end piece to separate said liquid from said granules, wherein said secondary conduit re-circulates said liquid by transporting said liquid to said top of said cleaning chamber.

9. The washing apparatus according to claim 8, further comprising a secondary pumping device and a secondary discharge pipe coupled to said secondary conduit.

10. The washing apparatus according to claim 2, wherein said granule collector and said second granule collector are positioned in side-by-side relation.

11. The washing apparatus according to claim 2, further comprising at least one shaft extending through each of said granule collector and said second granule collector, wherein each are rotatably mounted thereon.

12. The washing apparatus according to claim 11, further comprising an actuator disposed on the outside of said cleaning chamber, wherein said actuator is coupled to said at least one shaft, wherein said actuator is used to turn each of said granule collector and said second granule collector from an open position, wherein each of said granule collector and said second granule collector permits the passage of said mixture, to a closed position, wherein each of said granule collector and said second granule collector does not permit the passage of said mixture.

13. The washing apparatus according to claim 2, wherein each of said granule collector and said second granule collector comprise two side walls and two gable ends, wherein said side walls are perforated to allow the passage of liquid but restricting the passage of granules.

14. The washing apparatus according to claim 13, further comprising two shafts extending through each of said granule collector and said second granule collector, wherein each are rotatably mounted thereon, one shaft extending through each of said side walls, wherein said side walls are rotated between an open position, which is defined by an opening between said side walls, wherein said mixture is allowed to bypass each of said granule collector and said second granule collector, and a closed position, which is defined by the joining of said side walls, wherein said side walls and said gable ends form a container.

15. The washing apparatus according to claim 2, wherein each of said granule collector and said second granule collector further comprise four side walls and a bottom wall, wherein at least one of said walls is perforated to allow the passage of liquid but restricting the passage of granules.

16. The washing apparatus according to claim 15, further comprising a pivot pin extending between one of said side walls and said bottom wall, joining each of said bottom walls with a respective one of said side walls, wherein said bottom wall is rotated between a closed position, wherein said bottom wall meets said side walls to retain said granules therein, and an open position, wherein said mixture is allowed to pass between said bottom wall and said side walls.

17. The washing apparatus according to claim 1, wherein said cleaning chamber is divided into a treatment chamber, located in said top of said cleaning chamber, and a tank, located below said treatment chamber in said bottom of said cleaning chamber.

18. The washing apparatus according to claim 1, further comprising an actuator disposed on the outside of said cleaning chamber, wherein said actuator is coupled to said granule collector, wherein activating said actuator results in changing the position of said granule collector from an open position, wherein said granule collector permits the passage of said mixture, to a closed position, wherein said granule collector does not permit the passage of said mixture.

* * * * *